US009299272B2

(12) United States Patent
Stephanopoulos

(10) Patent No.: US 9,299,272 B2
(45) Date of Patent: Mar. 29, 2016

(54) POINT OF PURCHASE DISPLAY

(71) Applicant: KIDS II, INC., Atlanta, GA (US)

(72) Inventor: Anthony Stephanopoulos, Decatur, GA (US)

(73) Assignee: Kids II, Inc., Atlanta, GA (US)

( * ) Notice: Subject to any disclaimer, the term of this patent is extended or adjusted under 35 U.S.C. 154(b) by 0 days.

(21) Appl. No.: 14/300,542

(22) Filed: Jun. 10, 2014

(65) Prior Publication Data

US 2014/0366416 A1 Dec. 18, 2014

Related U.S. Application Data

(60) Provisional application No. 61/834,481, filed on Jun. 13, 2013.

(51) Int. Cl.

| | |
|---|---|
| ***G09F 15/00*** | (2006.01) |
| ***G09F 3/14*** | (2006.01) |
| ***B65B 61/20*** | (2006.01) |
| ***G09F 17/00*** | (2006.01) |

(52) U.S. Cl.

CPC . *G09F 3/14* (2013.01); *B65B 61/20* (2013.01); *G09F 15/0025* (2013.01); *G09F 17/00* (2013.01); *G09F 2017/0041* (2013.01)

(58) Field of Classification Search

CPC ..... G09F 15/0025; G09F 2015/0093; A47D 13/063

See application file for complete search history.

(56) References Cited

U.S. PATENT DOCUMENTS

| | | | | |
|---|---|---|---|---|
| 2,290,801 | A | 7/1942 | Dale et al. | |
| 2,461,682 | A * | 2/1949 | De Ferrari | 482/130 |
| 4,008,497 | A * | 2/1977 | Badon | 4/487 |
| 4,601,120 | A * | 7/1986 | Levin | 40/317 |
| 4,962,779 | A * | 10/1990 | Meng | 135/16 |
| 5,548,858 | A | 8/1996 | Shoa | |
| 5,649,390 | A * | 7/1997 | Davidson | 52/3 |
| 6,168,495 | B1 * | 1/2001 | Yoon | 446/478 |
| 6,301,731 | B1 * | 10/2001 | Jakubowski et al. | 5/658 |
| 6,799,337 | B1 | 10/2004 | Raphael-Davis et al. | |
| 6,895,611 | B2 | 5/2005 | Tharalson et al. | |
| 7,572,249 | B2 | 8/2009 | Betts | |
| 7,690,503 | B2 | 4/2010 | Foster et al. | |
| 7,998,127 | B2 | 8/2011 | Betts | |
| 8,371,896 | B2 | 2/2013 | Baytman et al. | |
| 8,465,336 | B2 | 6/2013 | Byrd | |
| 8,480,642 | B2 | 7/2013 | Betts | |
| 2005/0268398 | A1 | 12/2005 | Tharalson et al. | |
| 2006/0173734 | A1 | 8/2006 | Brandt | |
| 2006/0174525 | A1 * | 8/2006 | Hughes | 40/603 |
| 2006/0183086 | A1 | 8/2006 | Brandt | |
| 2006/0185082 | A1 * | 8/2006 | Casati Troutman | 5/99.1 |
| 2006/0288619 | A1 | 12/2006 | Henke et al. | |

(Continued)

FOREIGN PATENT DOCUMENTS

WO 2014042881 A1 3/2014

*Primary Examiner* — Gary Hoge

(74) *Attorney, Agent, or Firm* — Gardner Groff Greenwald & Villanueva, PC

(57) ABSTRACT

A point of purchase display for coupling to a commercial product on display at a retail store. The point of purchase display includes a flexible and wrinkle-resistant sheet material having indicia displayed thereon and at least one coupling member for coupling the sheet material to the commercial product. In example forms, the indicia being displayed on the sheet material is provided for advertisement or instructional purposes of the commercial product.

32 Claims, 4 Drawing Sheets

(56) References Cited

U.S. PATENT DOCUMENTS

2007/0125409 A1* 6/2007 Cullen ..... 135/33.41
2008/0314777 A1 12/2008 Foster et al.
2009/0222334 A1 9/2009 Shepherd et al.
2011/0067279 A1* 3/2011 Dos Santos Camacho ..... 40/601
2012/0073170 A1* 3/2012 Boltz et al. ..... 40/603
2014/0070676 A1 3/2014 Palgutt et al.

* cited by examiner

POINT OF PURCHASE DISPLAY

CROSS-REFERENCE TO RELATED APPLICATION

This application claims the benefit of U.S. Provisional Patent Application Ser. No. 61/834,481 filed Jun. 13, 2013, the entirety of which is hereby incorporated herein by reference for all purposes.

TECHNICAL FIELD

The present invention relates generally to the field of point of purchase displays for products, and more specifically to a point of purchase display for infant's and children's gear products.

BACKGROUND

Point of purchase displays are advertisements that can be positioned near or on a product that is being sold in a retail environment, so that potential purchasers may view the display with the product at the time of making a purchase decision. Many known point of purchase displays are formed from rigid plastic or cardboard, paper, or other materials, which can be easily damaged and/or are limited in their size, shape, attachment and positioning on the product, and present challenges in packaging and shipping the displays with the products.

It is often desirable to attach a point of purchase display to the product during the manufacture and/or packaging of the product for shipment to a retailer. But the size and shape of such displays typically are limited to the size and shape of the product's box or other packaging. For example, folding a typical rigid point of purchase display panel to fit within a product package that is smaller than the display size may damage the display and/or cause the display to be less visually appealing when set up at the retail site. Packaging a paper display with the product may cause the display to be wrinkled, creased, torn or otherwise disfigured during transport.

Furthermore, because packaging size is typically minimized for efficiency in delivery and storage of products, it has now been found desirable to provide point of purchase displays for a product that are larger than the product's packaging would otherwise allow. It has also been found that assembly and attachment of point of purchase displays to a product at a retail site can be expensive and require additional labor and logistics, either on the part of the retailer if they will do so, or on the part of manufacturers' representatives who are required to travel to the retail sites.

Accordingly, it can be seen that needs exist for an improved point of purchase display. It is to the provision of an improved point of purchase display meeting these and other needs that the present invention is primarily directed.

SUMMARY

In example embodiments, the present invention provides a point of purchase display for coupling to a commercial product on display at a retail store. In one aspect, the invention relates to a point of purchase display for coupling to a commercial product including a flexible and wrinkle-resistant sheet material and at least one coupling member for coupling the sheet material to the commercial product. In example forms, the sheet material has indicia displayed thereon. In one example form, the sheet material is formed from a 50D 160 gm/yd polyester trilobal tricot material and the at least one coupling element is in the form of a micro tag.

In another aspect, the invention relates to a point of purchase system for display at a retail store or other site, the system including a collapsible product, a flexible and wrinkle-resistant display, and at least one coupling element for coupling the display to the collapsible product. The collapsible product is generally movable between a collapsed configuration and an expanded configuration and includes at least one rigid structural member and at least one flexible fabric or soft goods component. The display preferably includes indicia thereon related to one or more features or characteristics of the product. In example forms, the display remains coupled to the collapsible product in both the collapsed configuration and the expanded configuration, wherein in the collapsed configuration the display is generally compacted, collapsed or bunched together, and wherein in the expanded configuration the sheet material is expanded to display the indicia thereon, for example on one or more flat, planar, wrinkle-free display surfaces. In one form, the sheet material is formed from a 50D 160 gm/yd polyester trilobal tricot material and the at least one coupling element is in the form of a micro tag.

In still another aspect, the invention relates to a method of assembling and packaging commercial goods. The method generally includes providing a commercial product, the commercial product being reconfigurable between a compact collapsed configuration and an expanded configuration; providing a display associated with the product, the display being formed from a substantially flexible and wrinkle-resistant material; positioning the commercial product in the expanded configuration; coupling the display to the commercial product; repositioning the commercial product into the collapsed configuration; and packaging the commercial product in combination with the display. In example forms, the commercial product comprises a children's gear product such as a collapsible play-yard, crib or sleeper. In one form, the display material is in the form of polyester trilobal tricot.

In yet another aspect, the invention relates to a method of marketing a collapsible commercial product. The method generally includes providing a substantially flexible and wrinkle-resistant display having indicia thereon; coupling the display to the collapsible commercial product; collapsing the collapsible commercial product to a collapsed configuration, the display collapsing and bunching together into a compact state to conform to the collapsed configuration of the product wherein at least a portion of the indicia of the display is generally hidden or obscured from visibility from a viewpoint external of the product; packaging the collapsed commercial product in packaging materials; shipping the collapsed commercial product to a retail store or other site; removing the collapsed commercial product from the packaging materials; expanding the collapsed commercial product to an expanded configuration, the display expanding therewith to conform to the expanded configuration wherein the indicia thereon becomes visible from a viewpoint external of the product; and displaying the commercial product at the retail store in combination with the display. In example forms, the collapsible commercial product is in the form of a children's gear product. In one example form, the display is formed from a polyester trilobal tricot material.

In still another aspect, the invention relates to a method of delivering information to a consumer. The method generally includes providing a commercial product on display at a retail store, the commercial product being movable between a collapsed configuration and an expanded configuration; and providing a substantially flexible and wrinkle-resistant display having indicia thereon, the display being coupled to the commercial product, wherein when the commercial product is in the expanded configuration the display is expanded to fully display the indicia thereon, and wherein when the commercial product is in the collapsed configuration the display is generally compacted or bunched together such that at least a portion of the indicia is no longer visible.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Generally described, the present invention comprises a point of purchase display for coupling to a commercial product on display at a retail store. In example forms, the commercial product is a children's gear product. Preferably, the display is formed from a flexible, compactable and wrinkle-resistant material. In one example form, the display is coupled to the product during the production or manufacture of the product, and the display remains coupled thereto until being removed after the product is purchased. In some example forms, the product on display (having the point of purchase display coupled thereto) is not for sale (e.g., an in-store sample) and is generally thrown away after the product is no longer being sold at the retail store. Preferably, the display is capable of being folded, crumpled, collapsed, compacted or bunched together when the product is collapsed and packaged and unfurled or opened into an intact and unwrinkled state when the product is erected and placed on display at a retail store or other display site, all while remaining coupled to the product.

Figure 1:
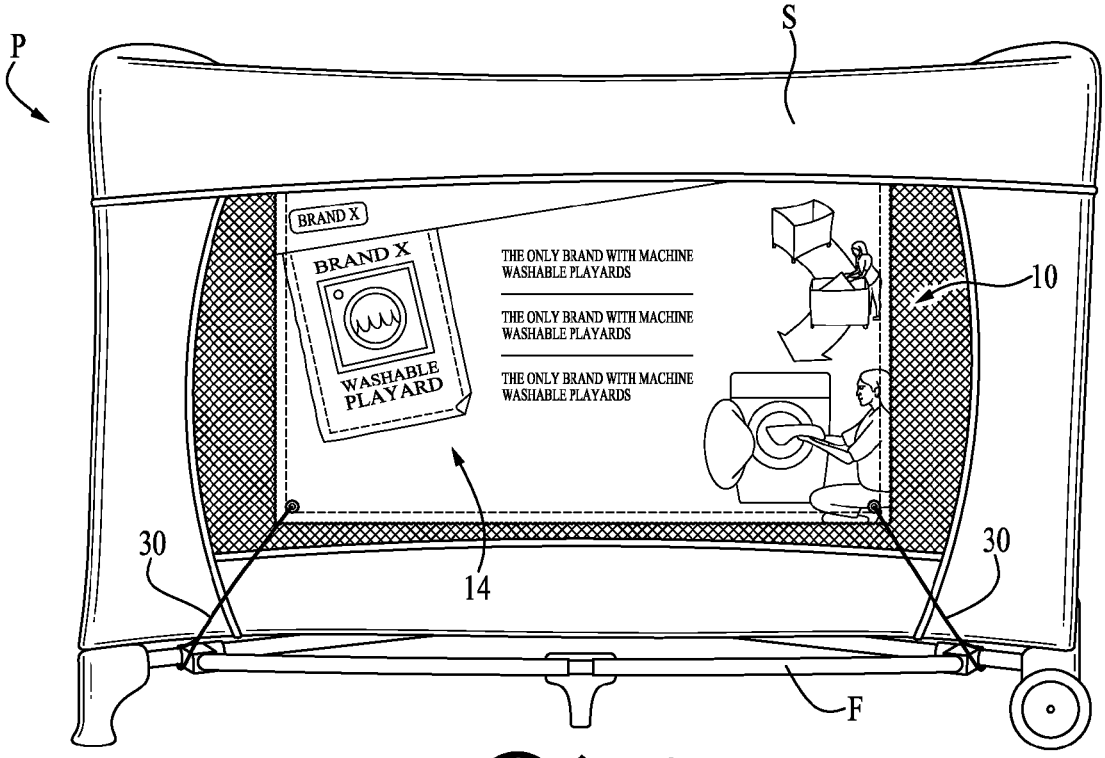
FIG. 1 is a front view of a product in an expanded configuration having a display coupled thereto according to an example embodiment of the present invention.

With reference now to the drawing figures, wherein like reference numbers represent corresponding parts throughout the several views, FIG. 1 shows an example embodiment of a point of purchase display 10 according to an example embodiment of the present invention. The point of purchase display 10 is preferably provided to be coupled to a product P on display at a retail store or the like. In one example form, the product P is in the form of a children's gear product, for example a play yard. Alternatively, the product P may take other forms including other children's gear products, for example nappers, sleepers, infant sleeping devices, rockers, other juvenile products, etc., or other types of expandable/compactable products. Typically, the product P will generally comprise one or more rigid structural components or frame members F and one or more soft goods components S. In some example embodiments, the product P is collapsible and capable of moving between a collapsed configuration and an expanded or in-use configuration. Generally, the product P is packaged and shipped in the collapsed configuration and on display at the retail store in the expanded configuration. Optionally, the product P may only comprise rigid structural members, for example, a high chair, stroller frame, etc. in which the display 10 may be attached thereto.

The display 10 is preferably formed from a flexible and wrinkle-resistant material. Thus, despite the display 10 being deformed, folded, crumpled or bunched together when the product P is collapsed while being packaged and shipped (see FIG. 5), the display 10 unfurls into an intact and substantially wrinkle-free state when the product is removed from its box and erected into the in-use or expanded configuration (see FIGS. 1 and 7). In one example form, the display 10 is formed from 50D 160 gm/yd polyester trilobal tricot material with paper print. Optionally or alternatively, other materials including polypropylene, polyethylene, mesh, other polyesters, Tyvek®, non-woven materials, and/or other materials or combinations thereof may be incorporated into the display.

Preferably, indicia 14 can be printed or otherwise applied on a display surface of the display 10 for advertisement or instructional purposes, which may include product branding, graphical illustrations, written material, etc. For example, the indicia 14 can include certain aspects or benefits of the product P, instructions on how to use the product P, or other graphics or written material for advertisement or branding purposes. In example forms, the indicia 14 can be printed on the display 10 using a paper print process, a transfer printing process, or by dye sublimation. Optionally, other printing techniques may be employed. In alternative embodiments, the indicia 14 can be adhered to the display by gluing, tacking, or other coupling methods. Further optional, additional accessory advertisements can be provided on the display 10, which can include "try-me" or example alternative fabrics/materials that are being used with the product 10 (e.g., soft goods or available as options, allowing the customer to touch the materials and see them up close), or a quick response code (QR code) to link the user to additional advertising material online or elsewhere.

Figure 2:
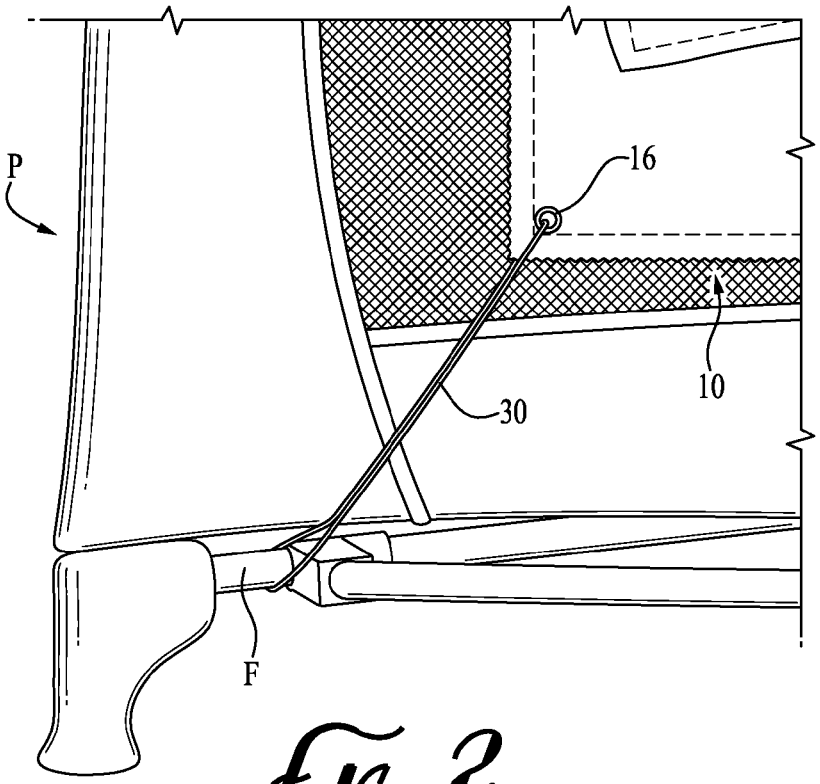
FIG. 2 is a detailed view of a portion of the display coupled to the product of FIG. 1.

In the example embodiment depicted in FIG. 1, the display 10 is generally rectangular in shape and coupled to a central area of one side of the product P, comprising one or more generally flat or planar display surfaces when the product is expanded. In one example form, the display 10 is preferably coupled to both the frame F and the soft goods components S. For example, each of the bottom corners of the display comprise a grommet 16 to receive an elastic string 30 that is attached to the frame F, and the upper corners of the display are coupled to portions of the soft goods components S by micro tags (i.e., swift tags) 34. Preferably, when the product is in the expanded configuration, the elastic string 30 pulls or applies tension to the display 10 to remove any slack or wrinkles from the display 10 (see FIG. 2), and the micro tags 34 allow the display 10 to be attached flush with the soft goods components S (see FIGS. 3-4). Thus, the attachment of the display 10 to the product P preferably applies appropriate tension to the display 10 to provide a substantially wrinkle-free display 10 that is generally flush or adjacent the product P. In some example embodiments, the tension applied to the display 10 is due to the attachment position on the product P (e.g., where display 10 is attached to product P) such that when the product is in the expanded configuration, the display 10 coupled thereto is expanded and receives the appropriate tension to provide a substantially wrinkle-free display 10. For example, in some forms, the display 10 can be coupled to the product P when the product P is in the semi-collapsed configuration (or a position between the semi-collapsed and expanded configurations) such that the display is forced to undergo tension being applied from the attachment points (micro tags, etc.) when the product P is in the expanded configuration. In alternative embodiments, the display 10 can be coupled to only soft goods components S or only the rigid structural components F. In example forms, the product P includes at least two product attachment points which are spaced a first lesser distance apart from one another (i.e., closer to one another) in the product's collapsed state, and spaced a second greater distance apart from one another (i.e., further from one another) in the product's expanded state, and the display includes corresponding display attachment points for paired connection to the product attachment points, such that the display expands and unfurls in at least one dimension in conjunction with expansion of the product as the product attachment points move apart from one another during erection and assembly. Optionally, three, four or more cooperating attachment point pairs may be provided for coupling the display to the product at spaced apart locations, and expanding and unfurling the display in one, two or three dimensions in conjunction with expansion of the product.

Figure 3:
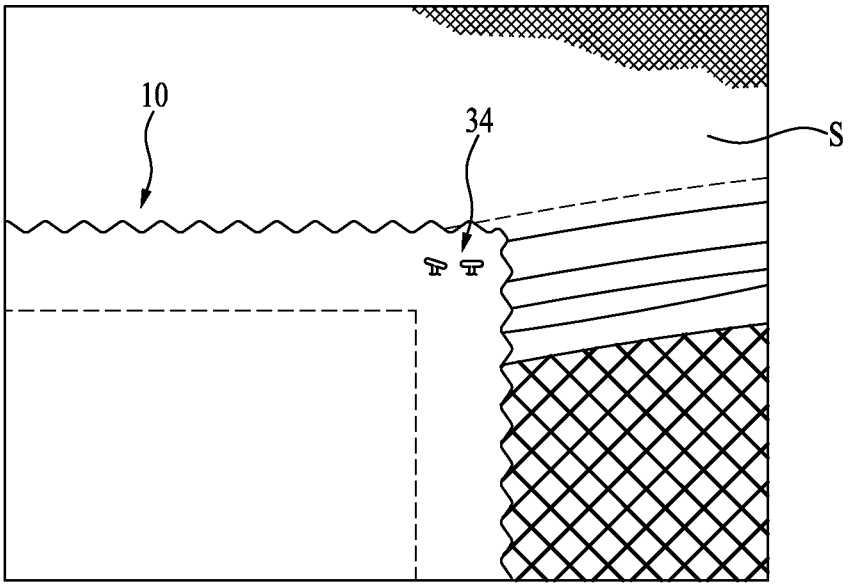
FIG. 3 is a detailed view of an upper portion of the display coupled to the product of FIG. 1.
Figure 4:
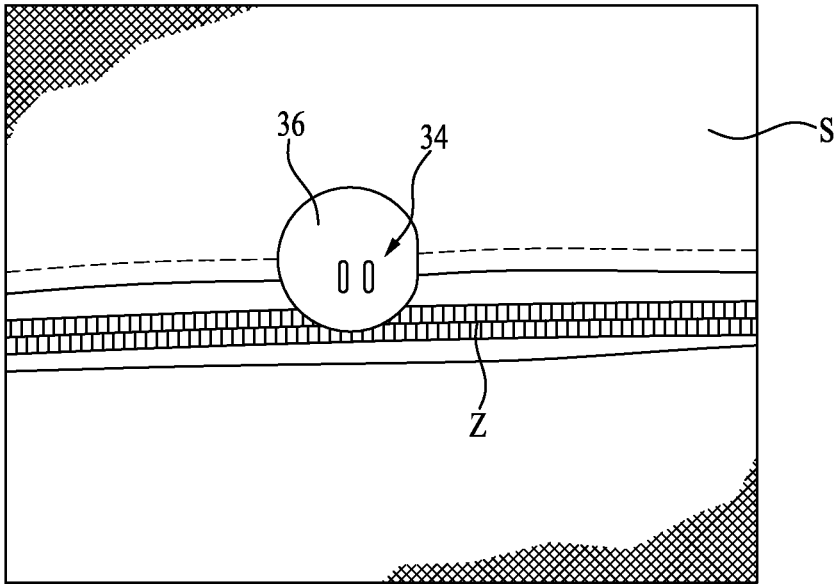
FIG. 4 is a detailed view of an upper interior portion of the product of FIG. 1, showing a backing member for supporting attachment members extending through a portion of the display and the product for coupling the display to the product.

In example embodiments, the grommets 16 are generally formed from a rigid material and spaced inwardly relative to the two corners of the bottom portion of the display 10. In one form, the grommets are spaced inwardly about 1", more preferably about 2", and more preferably about 3"-5". Optionally, the grommets 16 may be provided along other portions of the display 10. For example, in one example form, the sides of the display can be folded over and stitched or hemmed (see dashed line) to provide clean edges, and the grommets 16 can be positioned to be generally adjacent the edges. Optionally, the grommets 16 may be formed from other less rigid materials to provide a range of flexibility. As depicted in FIGS. 3-4, the micro tags 34 generally extend through one or more portions of the soft goods components S to attach the upper portions of the display 10 to the product P, which allow the display 10 to mount generally flush to the product 10. In one example form, a generally disc-like backing member 36 is provided behind an interior portion of the soft goods components S to provide for additional support to the micro tags 34, for example, to ensure that the micro tags 34 do not pull through or cause damage to the soft goods components S. In some example forms, the micro tags 34 extend through portions of tape or fabric of a zipper or coupling element Z of the soft goods components S. Optionally, other conventional attachment methods including zip-ties, wire, fabric strips, rubber bands, elastic members, injection molded parts, hook and loop material, thread, other coupling members or combinations thereof may be employed to couple the display 10 to the product P. Further optionally, the display 10 can be configured to receive one or more additional display elements. For example, the grommets 16, which are provided for coupling the display 10 to the product P with the elastic string 30, can be configured to receive coupling elements of the additional display such that the additional display is coupled to and supported by the grommets 16 of the display 10.

Figure 5:
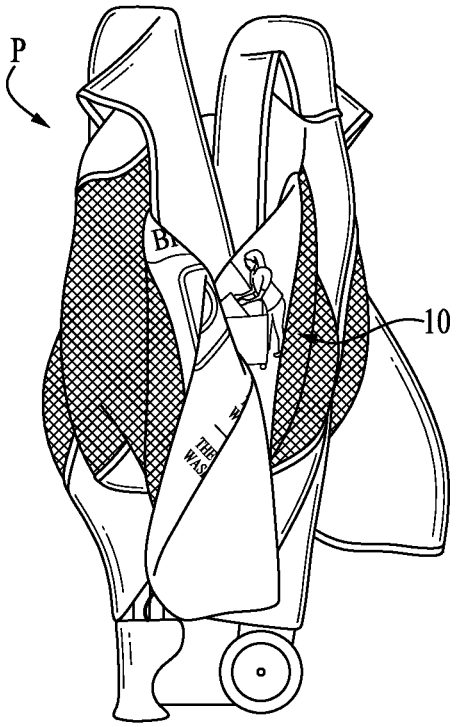
FIG. 5 is a front view of the product of FIG. 1 in a collapsed configuration, showing the display coupled thereto being collapsed and bunched together.
Figure 6:
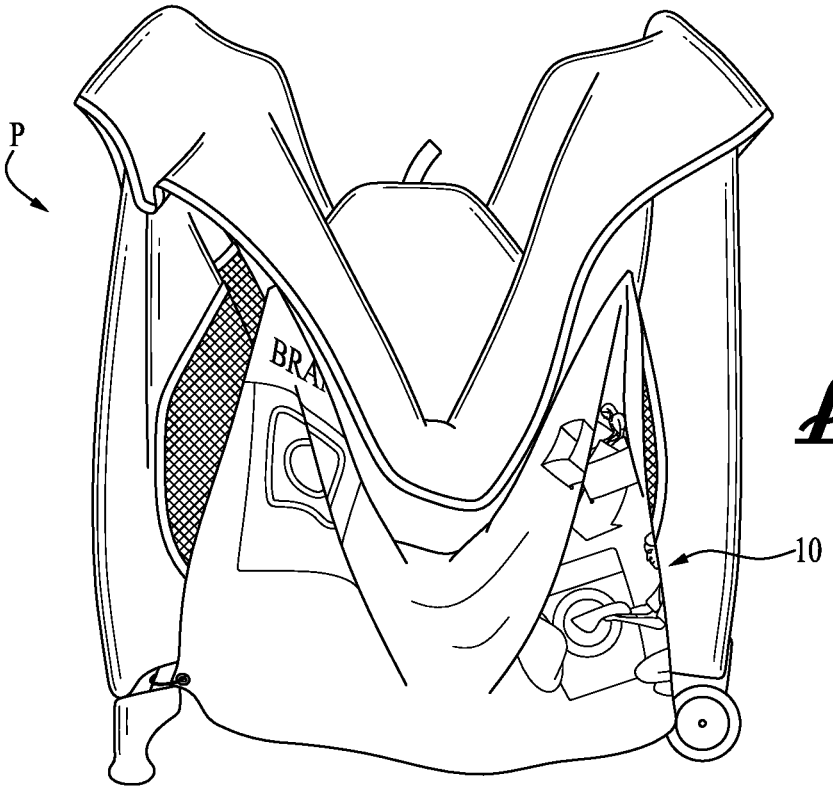
FIG. 6 is a front view of the product of FIG. 5 in a partially expanded or semi-collapsed configuration, showing the display coupled thereto being unfurled in conjunction with the erection of the product into its expanded state.
Figure 7:
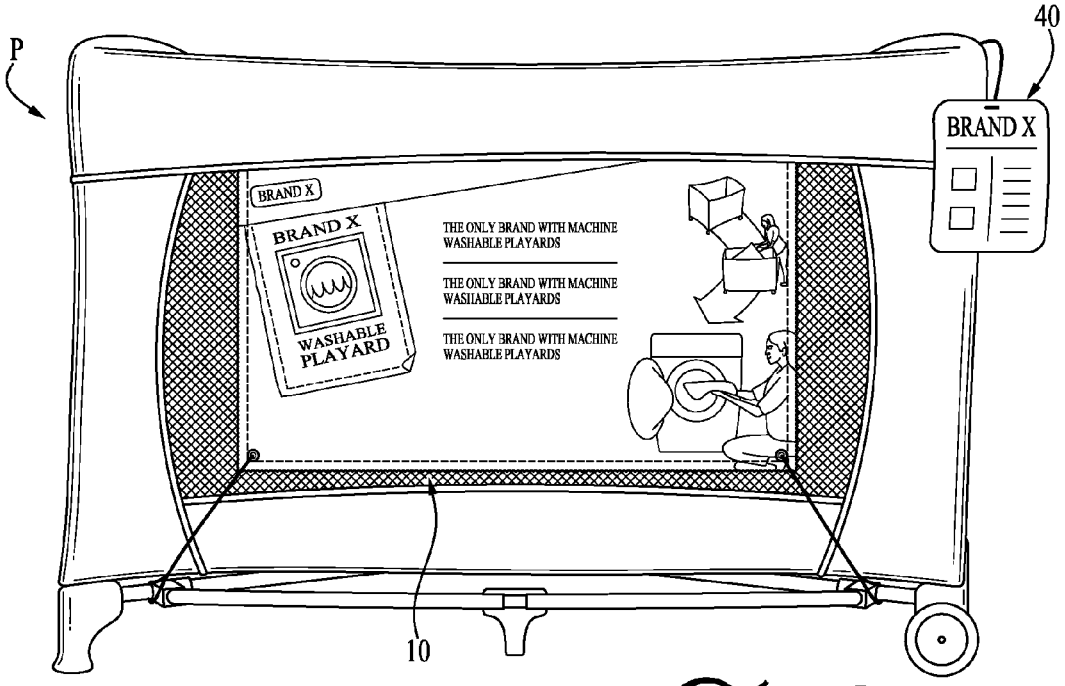
FIG. 7 is a front view of the product of FIG. 1, showing the display coupled thereto being fully unfurled and expanded and including an additional point of purchase display tag attached to a portion of the product.

In example forms, as briefly described above, the product P is collapsible and capable of moving between a collapsed configuration and an expanded or in-use configuration, and the display 10 coupled thereto is preferably folded or bunched together when the product P is in the collapsed configuration and unfolded, fully opened or expanded when the product P is in the in-use configuration, with the unfurling of the display being linked or coupled to expansion of the product such that opening of the display is automatically carried out by expansion of the product. Thus, the configuration of the display 10 (e.g., bunched together or unfolded) generally depends on and is driven by the configuration of the product P (e.g., collapsed or expanded). For example, as depicted in FIGS. 5-7, the display 10 is configured to conform to the configuration of the product P as it moves between the collapsed configuration and the expanded configuration during assembly and take-down. FIG. 5 shows the product in the collapsed configuration and the display 10 is in the substantially folded or collapsed configuration. FIG. 6 shows the product in a semi-collapsed, partially expanded or intermediate configuration (e.g., between the collapsed and expanded configurations) and the display 10 is in a generally semi-collapsed configuration. As depicted, at least a portion of the indicia 14 being displayed on the display 10 is generally hidden from visibility when viewed from a vantage point external of the product as it is collapsed. And, FIG. 7 shows the product P in the expanded configuration and the display 10 is in the expanded configuration. As depicted, the indicia 14 being displayed on the display 10 is substantially intact, visible from an external vantage point, and wrinkle-free in appearance. Optionally, the display 10 may be wrapped or folded around the product P such that it is not generally bunched together and wherein a portion thereof is hidden from visibility. Further optionally, a secondary display 40 can be coupled to the product to provide additional advertisements, instructions, etc., in addition to the primary display 10. As similarly described above, the secondary display 40 is generally coupled to the product P by micro tags 34 or other coupling elements, for example at the time of manufacture and packaging of the product for delivery to a retail site. In typical embodiments, the secondary display 40 is substantially smaller in size than the display 10 and is generally formed from a plastic or paper material optionally exhibiting at least a small amount of rigidity. Optionally, the secondary display 40 can be formed from other materials as desired.

Figure 8:
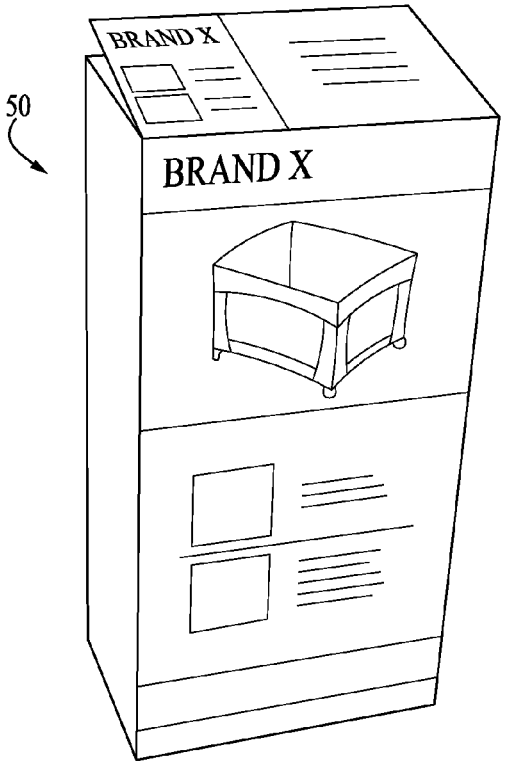
FIG. 8 is a perspective view of the product of FIG. 1 contained within a packaging carton or box, in its collapsed configuration.

Packaging materials such as a bag, carton or box 50 are preferably provided to package the product P for shipping to the retail store or other distribution center. As depicted in FIG. 8, the box 50 is generally sized and shaped to provide an envelope sufficient for fitting the collapsed product P (and display 10 coupled thereto, see FIG. 5) therein. Typically, after the manufacture and assembly of the product P, the product P is opened to the expanded configuration and the display 10 (and optional second display 40) is coupled to the product P. The product P is then collapsed to the collapsed configuration and packaged within the box 50, which is shipped to the retail store. Upon arrival, the product P is removed from the box 50 and expanded to the in-use configuration for being displayed at the retail store. Preferably, during the removal and display of the product P at the retail store, the display 10 remains coupled to the product P and effortlessly expands to the expanded configuration to be displayed on the product P. In example forms, the display 10 is larger in at least one dimension when expanded than a corresponding dimension of the box 50, such that the display would not fit into the box without collapsing the display into a more compact state by folding or bunching of the display. Optionally, both the width and the length of the expanded display are greater than corresponding dimensions of the box, such that the display is compacted in both dimensions when collapsed to fit within the box. Preferably, the size and configuration of the display 10 is unconstrained by the size and configuration of the compacted or collapsed commercial product P or its packaging (e.g., box 50).

In another aspect, the present invention relates to a method of assembling and packaging commercial goods. In one example form, the method comprises providing a commercial product, the commercial product being positionable between a collapsed configuration and an expanded configuration; providing a display, the display being substantially flexible and wrinkle-resistant; positioning the commercial product in the expanded configuration; coupling the display to the commercial product; positioning the commercial product in the collapsed configuration; and packaging the commercial product. Optionally, the display can be coupled to the product when the product is in either of the semi-collapsed or collapsed configurations.

In yet another aspect, the present invention relates to a method of marketing a collapsible commercial product. In one example form, the method comprises providing a substantially flexible and wrinkle-resistant display having indicia printed thereon; coupling the display to the collapsible commercial product; collapsing the collapsible commercial product to a collapsed configuration, the display collapsing to conform to the collapsed configuration; packaging the collapsed commercial product and display in packaging materials; shipping the collapsed commercial product and display to a retail store; removing the collapsed commercial product and display from the packaging materials; expanding the collapsed commercial product to an expanded configuration, and causing the display to expand to conform to the expanded configuration wherein the indicia printed thereon is visible; and displaying the collapsible commercial product at the retail store.

In another aspect, the present invention relates to a method of delivering information to a consumer. In one example form, the method comprises providing a commercial product on display at a retail store, the commercial product being movable between a collapsed configuration and an expanded configuration; and providing a substantially flexible and wrinkle-resistant display having indicia thereon, the display being coupled to the commercial product, wherein when the commercial product is in the expanded configuration the display is expanded to display the indicia thereon, and wherein when the commercial product is in the collapsed configuration the display is generally compacted or bunched together such that at least a portion of the indicia on the display is no longer visible from an external vantage point.

In additional example embodiments, the display 10 can be shaped and sized as desired. For example, optional shapes of the display 10 can include rectangular, square, hexagonal, polygonal, circular, oval, irregular, or other desired shapes. Preferably, the size of the display 10 can be configured to cover all or a portion of at least one side (front, back, ends, top or bottom) of the product P, and in some example forms the display 10 is configured to cover at least two or more adjacent side portions. Optionally, two or more displays 10 can be provided to separately cover at least portions of two or more sides of the product P. Furthermore, the display may optionally comprise one or more animated or lenticular displays, which may be used to produce a three-dimensional image or animation.

While the invention has been described with reference to preferred and example embodiments, it will be understood by those skilled in the art that a variety of modifications, additions and deletions are within the scope of the invention, as defined by the following claims.

What is claimed is:

1. A point of purchase display for attachment to a commercial product, the commercial product being distinct from the point of purchase display, the display comprising a flexible and wrinkle-resistant sheet material having indicia displayed on a display surface thereof, and at least one coupling member for coupling the sheet material to the commercial product, wherein the display is reconfigurable between an expanded configuration and a compacted configuration, wherein upon reconfiguration of the display from the compacted configuration to the expanded configuration the display presents an intact and substantially wrinkle-free appearance, wherein the at least one coupling member comprises a micro tag, and wherein the indicia displayed on the display surface comprises information about the commercial product to which the display is attached.

2. The point of purchase display of claim 1, wherein the sheet material comprises a 50D 160 gm/yd polyester trilobal tricot material.

3. The point of purchase display of claim 1, further comprising at least one grommet secured to a portion of the sheet material.

4. The point of purchase display of claim 3, further comprising at least one coupling member in the form of an elastic string for coupling the at least one grommet to the commercial product.

5. The point of purchase display of claim 4, wherein the commercial product comprises rigid structural members and soft goods, and wherein the sheet material is coupled to at least a portion of both the rigid structural members and the soft goods.

6. The point of purchase display of claim 1, wherein the commercial product is in the form of a collapsible children's gear product.

7. The point of purchase display of claim 1, wherein the point of purchase display is a first size and configuration and the commercial product is a second size and configuration in the compacted configuration for being packaged with packaging materials, and wherein the size and configuration of the display is unconstrained by the size and configuration of the compacted commercial product or its packaging materials.

8. A point of purchase system comprising:

a collapsible product movable between a collapsed configuration and an expanded configuration, the collapsible product comprising at least one rigid structural member and at least one soft goods component;

a flexible and wrinkle-resistant display comprising indicia thereon, the collapsible product being distinct from the display, and the indicia on the display comprising information relating to at least one aspect of the collapsible product; and at least one coupling element for coupling the display to the collapsible product, wherein the at least one coupling member comprises a micro tag, wherein the display remains coupled to the collapsible product in both the collapsed configuration and the expanded configuration, wherein in the collapsed configuration the display is generally compacted, and wherein in the expanded configuration the sheet material is opened to display the indicia thereon.

9. The point of purchase system of claim 8, wherein the sheet material comprises a 50D 160 gm/yd polyester trilobal tricot material.

10. The point of purchase system of claim 8, further comprising at least one grommet secured to a portion of the display.

11. The point of purchase display of claim 10, further comprising at least one coupling member in the form of an elastic string for coupling the at least one grommet of the display to the collapsible product.

12. The point of purchase display of claim 11, wherein the sheet material is coupled to at least a portion of both the rigid structural members and the soft goods components.

13. A point of purchase system comprising:

a collapsible product movable between a collapsed configuration and an expanded configuration, the collapsible product comprising at least one rigid structural member and at least one soft goods component, wherein the collapsible product comprises a children's gear product, wherein the children's gear product comprises a play yard;

a flexible and wrinkle-resistant display comprising indicia thereon, the collapsible product being distinct from the display, and the indicia on the display comprising information relating to at least one aspect of the collapsible product; and at least one coupling element for coupling the display to the collapsible product, wherein the display remains coupled to the collapsible product in both the collapsed configuration and the expanded configuration, wherein in the collapsed configuration the display is generally compacted, and wherein in the expanded configuration the sheet material is opened to display the indicia thereon.

14. A method of assembling and packaging commercial goods comprising:

providing a commercial product, the commercial product being reconfigurable between a collapsed configuration and an expanded configuration, wherein the commercial product comprises a children's gear product, wherein the children's gear product comprises a play yard, and wherein the play yard comprises rigid structural members and soft good components;

providing a display, the display being formed from a substantially flexible and wrinkle-resistant material, the commercial product being distinct from the display, and the display comprising indicia thereon including information relating to the commercial product;

positioning the commercial product in the expanded configuration;

coupling the display to the commercial product;

positioning the commercial product in the collapsed configuration; and packaging the commercial product.

15. The method of claim 14, wherein the display material comprises a polyester trilobal tricot.

16. The method of claim 14, wherein the display is coupled to at least a portion of both the rigid structural members and the soft goods components.

17. The method of claim 14, wherein the display is coupled to at least a portion of only the rigid structural members or the soft good components.

18. A method of marketing a collapsible commercial product comprising:

providing a substantially flexible and wrinkle-resistant display having indicia thereon, the collapsible commercial product being distinct from the display, and the display comprising indicia thereon including information about the collapsible commercial product;

coupling the display to the collapsible commercial product, wherein the display is coupled to the collapsible commercial product by at least one micro tag;

collapsing the collapsible commercial product to a collapsed configuration, the display compressing to conform to the collapsed configuration wherein at least a portion of the indicia of the display is generally hidden from visibility;

packaging the collapsed commercial product in packaging materials;

shipping the collapsed commercial product to a retail store;

removing the collapsed commercial product from the packaging materials;

expanding the collapsed commercial product to an expanded configuration, the display expanding in conjunction with the product to conform to the expanded configuration wherein the indicia thereon is visible; and displaying the commercial product at the retail store.

19. The method of claim 18, wherein the display comprises a polyester trilobal tricot material.

20. The method of claim 18, wherein the collapsible commercial product comprises a children's gear product.

21. A method of marketing a collapsible commercial product comprising:

providing a substantially flexible and wrinkle-resistant display having indicia thereon, the collapsible commercial product being distinct from the display, and the display comprising indicia thereon including information about the collapsible commercial product;

coupling the display to the collapsible commercial product, wherein the display is coupled to the collapsible commercial product by at least one coupling member in the form of an elastic string;

collapsing the collapsible commercial product to a collapsed configuration, the display compressing to conform to the collapsed configuration wherein at least a portion of the indicia of the display is generally hidden from visibility;

packaging the collapsed commercial product in packaging materials;

shipping the collapsed commercial product to a retail store;

removing the collapsed commercial product from the packaging materials;

expanding the collapsed commercial product to an expanded configuration, the display expanding in conjunction with the product to conform to the expanded configuration wherein the indicia thereon is visible; and displaying the commercial product at the retail store.

22. The method of claim 21, further comprising securing at least one grommet to a portion of the display and looping the at least one elastic string through the grommet.

23. A method of delivering information to a consumer comprising:

providing a commercial product on display at a retail store, the commercial product being movable between a collapsed configuration and an expanded configuration; and providing a substantially flexible and wrinkle-resistant display having indicia thereon, the display being coupled to the commercial product, wherein when the commercial product is in the expanded configuration the display is expanded to display the indicia thereon, and wherein when the commercial product is in the collapsed configuration the display is generally bunched together such that at least a portion of the indicia is no longer visible, and wherein the commercial product is distinct from the display, and wherein the indicia on the display includes information related to the commercial product.

24. A point of purchase display for attachment to a commercial product, the display comprising a flexible and wrinkle-resistant sheet material having indicia displayed on a display surface thereof, and at least one micro tag for coupling the sheet material to the commercial product, wherein the display is reconfigurable between an expanded configuration and a compacted configuration, and wherein upon reconfiguration of the display from the compacted configuration to the expanded configuration the display presents an intact and substantially wrinkle-free appearance.

25. A point of purchase system comprising:

a collapsible product movable between a collapsed configuration and an expanded configuration, the collapsible product comprising at least one rigid structural member and at least one soft goods component;

a flexible and wrinkle-resistant display, the display comprising indicia thereon; and at least one micro tag for coupling the display to the collapsible product, wherein the display remains coupled to the collapsible product in both the collapsed configuration and the expanded configuration, wherein in the collapsed configuration the display is generally compacted, and wherein in the expanded configuration the sheet material is opened to display the indicia thereon.

26. A point of purchase system comprising:

a collapsible children's play yard product movable between a collapsed configuration and an expanded configuration, the collapsible children's play yard product comprising at least one rigid structural member and at least one soft goods component;

a flexible and wrinkle-resistant display, the display comprising indicia thereon; and at least one coupling element for coupling the display to the collapsible children's play yard product, wherein the display remains coupled to the collapsible children's play yard product in both the collapsed configuration and the expanded configuration, wherein in the collapsed configuration the display is generally compacted, and wherein in the expanded configuration the sheet material is opened to display the indicia thereon.

27. A method of assembling and packaging commercial goods comprising:

providing a commercial product, the commercial product comprising a children's play yard product comprising rigid structural members and soft good components, and being reconfigurable between a collapsed configuration and an expanded configuration;

providing a display, the display being formed from a substantially flexible and wrinkle-resistant material;

positioning the children's play yard product in the expanded configuration;

coupling the display to the children's play yard product;

positioning the children's play yard product in the collapsed configuration; and packaging the children's play yard product.

28. The method of claim 27, wherein the display is coupled to at least a portion of both the rigid structural members and the soft goods components.

29. The method of claim 27, wherein the display is coupled to at least a portion of only the rigid structural members or the soft good components.

30. A method of marketing a collapsible commercial product comprising:

providing a substantially flexible and wrinkle-resistant display having indicia thereon;

coupling the display to the collapsible commercial product by at least one micro tag;

collapsing the collapsible commercial product to a collapsed configuration, the display compressing to conform to the collapsed configuration wherein at least a portion of the indicia of the display is generally hidden from visibility;

packaging the collapsed commercial product in packaging materials;

shipping the collapsed commercial product to a retail store;

removing the collapsed commercial product from the packaging materials;

expanding the collapsed commercial product to an expanded configuration, the display expanding in conjunction with the product to conform to the expanded configuration wherein the indicia thereon is visible; and displaying the commercial product at the retail store.

31. A point of purchase display for attachment to a children's play yard product, the play yard product being reconfigurable between a collapsed play yard configuration and an expanded play yard configuration, the display comprising a flexible sheet material having information about the play yard product displayed on a display surface thereof, the display being coupled to the play yard product to move between a compacted display configuration when the play yard product is in its collapsed play yard configuration and an expanded display configuration when the play yard product is in its expanded play yard configuration.

32. A point of purchase system comprising:

a collapsible children's play yard product movable between a collapsed play yard configuration and an expanded play yard configuration, the play yard comprising at least one rigid structural member and at least one soft goods component; and a flexible display coupled to the children's play yard product, the flexible display having information about the children's play yard product on a display surface thereof;

wherein the flexible display remains coupled to the children's play yard product in both the collapsed play yard configuration and the expanded play yard configuration, wherein in the collapsed configuration the display is generally compacted, and wherein in the expanded configuration the sheet material is opened to display the information about the children's play yard product.

* * * * *